United States Patent [19]

Smith

[11] Patent Number: 5,033,122

[45] Date of Patent: Jul. 23, 1991

[54] DISPOSABLE SWEAT BAND

[76] Inventor: Edward Smith, 2590 Weymouth Rd., Hinckley, Ohio 44233

[21] Appl. No.: 495,959

[22] Filed: Mar. 19, 1990

[51] Int. Cl.[5] ..... A42B 1/00; A42C 5/02

[52] U.S. Cl. ..... 2/209.3; 2/170; 2/181; 2/DIG. 11

[58] Field of Search ..... 2/171, 209.3, 170, DIG. 11, 2/181, 197, 243 R

[56] References Cited

U.S. PATENT DOCUMENTS

| | | | |
|---|---|---|---|
| 1,391,902 | 9/1921 | Martin | 2/181 |
| 1,434,854 | 11/1922 | Stall | 2/171 |
| 1,559,917 | 11/1925 | Schnebel | 2/182.6 |
| 1,633,586 | 6/1927 | Hunter | 2/171 |
| 1,957,356 | 5/1934 | Rosen | 132/59 |
| 2,628,361 | 2/1953 | Heyek | 2/181 |
| 2,783,474 | 3/1957 | Capagna et al. | 2/171 |
| 2,965,584 | 12/1960 | Elkin | 521/128 |
| 3,089,146 | 3/1963 | Sterne | 2/181 |
| 4,394,782 | 7/1983 | Wasson | 2/181 |
| 4,468,817 | 9/1984 | Nunnery et al. | 2/181 |
| 4,481,681 | 11/1984 | Hankin | 2/197 |
| 4,502,156 | 8/1985 | Wishman | 2/181 |
| 4,521,922 | 6/1985 | Mitchell | 2/171 |
| 4,656,671 | 4/1987 | Manges | 2/DIG. 11 X |
| 4,831,997 | 5/1989 | Greene | 2/170 X |
| 4,833,734 | 5/1989 | Estephanian | 2/171 |
| 4,941,210 | 7/1990 | Konucik | 2/209.3 X |

FOREIGN PATENT DOCUMENTS

85/00132 6/1985 PCT Int'l Appl. .

*Primary Examiner*—Peter Nerbun

[57] ABSTRACT

A disposable and short-term bio-degradable sweat band suitable for collecting and controlling perspiration. The band is completely formed by an arrangement of laminations. The absorbent pad is extra long, allowing it to completely encircle the forehead and form a double pad over the area of heaviest sweat. The absorbent surface is always in direct contact with the sweat area. The band uses no elastic tensioning fasteners but it is adjustable as to head size and band tension. The sweat band can be folded into a small self-contained pocket pack with a pull tab for easy opening.

15 Claims, 2 Drawing Sheets

DISPOSABLE SWEAT BAND

FIELD OF INVENTION

This invention relates to wearing apparel, especially sweat bands and sweat cuffs.

BACKGROUND ART

The practice of wrapping an absorbent material around one's forehead to collect, and control brow perspiration during periods of vigorous physical exercise and work has long been used. As perspiration or sweat accumulates on the forehead it drips and runs, and intermixes with any contaminates that may be present in the ambient environment and thus becomes potentially harmful. If uncontrolled, the accumulated perspiration will flow into the eyes. This aggravation and discomfort is amplified if a person wears eye glasses or contact lenses.

A second area where perspiration accumulates is on the forearm. The uncontrolled perspiration will flow onto the palms of the hands making it difficult to grasp tools, etc. This uncontrolled flow of perspiration can contaminate work areas and materials being processed.

Heretofore, sweat bands typically have consisted of an absorbent pad held in place over the perspiring area by a tensioning band. The absorbent materials frequently used are terry cloth toweling, synthetic sponge, and synthetic non-woven spun filaments. These materials, however, create certain problems. They are expensive and must be used sparingly to be economically and competitively priced. They are usually used in the form of pads, which many times are too large for a small head and/or too small for a large head. The pads must have a binding sewn around them to control loose threads, or they must be placed in a wrapper and sewn in place in the brow area of the sweat band. The wrapper for the pads forms the tension band. The wrappers are most often made of non-absorbent woven nylon or rayon fabric. In use, the wrappers are placed into direct contact with the skin of the perspiring area. The secreted perspiration must first fill the interstices between individual fibers of the fabric band material and saturate it before it can be transferred to the intended absorbent pad. The contact area is in a state of continual saturation, a condition conducive to rashes.

As previously noted, the band must be tensioned in order to retain it in position. The tensioning of the band tends to close the interstices of the band fabric. Since the absorbent matter is not in direct contact with the skin, and the interstices of the fabric have been reduced, the efficiency of the sweat band is greatly reduced. Still more assembly is required to add tension adjusting fasteners. Sweat bands are frequently tensioned by either elastic strips or with hook and loop fasteners. Sometimes, only a single strand of rubber band like material is attached to the ends of the sweat band with a metal staple. Wider elastic strips can be used, but this increases both material cost and assembly labor. The hook and loop materials are expensive. Their placement on the sweat band is critical and requires additional assembly time. The two components of this fastener are stiff and bulky when pressed together. Also, sweat bands using hook and loop fasteners usually do not allow for infinite adjustment, so that one size must fit all.

In use, all sweat bands become saturated and contaminated with ambient environment pollutants. Sweat bands assembled of pads and fabric wrappers must be washed and dried after each use. However, the sweat band of the present invention is made of inexpensive and short-term bio-degradable materials and can be discarded after use.

Another advantage to the sweat band of the present invention is that the entire absorbent face thereof is in direct contact with the area of perspiration and completely surrounds the user's head. The length of the absorbent pad is such that it extends one and one half times around the user's head. This arrangement allows a double thickness of the absorbent pad to be in direct contact with the area of heaviest perspiration. As one area of the band becomes saturated, it can be rotated slightly relative to the user's head so that a drier area of the band can be placed over the area of heavy perspiration. The overlap allows one size to fit all. It also eliminates the need of forming an "area pad" and all the associated assembly costs. The sweat band of the present invention also allows for infinite tensioning and infinite size adjustment without the use of additional fasteners. This feature eliminates the cost of fasteners and assembly labor. The total perspiration area is always in direct contact with the absorbent face of the sweat band. This provides the highest absorbent efficiency possible.

Other embellishments can be incorporated into the design such as:

(1) addition of insect repellent;
(2) addition of any desirable scent;
(3) personalized marking, name, etc.;
(4) addition of advertising message printed on the binder;
(5) can be furnished in a pocket pack which is flat; and,
(6) can be furnished in a pocket pack which is round.

The foregoing explanation describes a novel laminating process of fabricating an inexpensive, disposable and bio-degradable sweat band. The unique design allows it to be completely fabricated on very high production machines. Notwithstanding the fact that the absorbent pad of the present sweat band is several times longer than the pad of existing sweat bands, the pocket pack as manufactured by the machine is much smaller than existing packs. The novel design eliminates the use of special band tensioning fasteners, while providing infinite adjustability. In addition, a pull tab is provided to aid in the installation and tensioning of the sweat band, as well as a quick release when the band is ready to be discarded. The above advantages are in addition to the capability of the sweat band to efficiently collect and control excessive perspiration, while eliminating the possibility of aggravating perspiration flowing into the eyes. Other possible uses for the absorbent pad of the present invention will include condensate collars and coasters for cold drink glasses and bottles.

SUMMARY OF THE INVENTION

This invention relates to disposable and short-term bio-degradable wearing apparel such as sweat bands and sweat cuffs. The sweat band is of laminated construction and can be completely assembled on high capacity production machinery. The band comprises a folded, flat strip of absorbent paper toweling. Any number of plies can be included in the band by increasing the number of folds. For example, a twelve ply band, approximately one and one half inches wide and twenty-seven inches long will be used for purposes of discussion, although other dimensional relationships could also be used to advantage. A high tensile strength binding lamination, having a pressure-sensitive adhesive backing is secured in place over the folded edges of the band for locking them in place and completing the assembly. The binding lamination has a greater length than the absorbent band, thus providing a tail extending beyond the absorbent pad. In the example here under discussion, the binding lamination is approximately three quarters of an inch wide and has a length of approximately thirty-two inches so that the tail portion is approximately five inches. Here, too, other dimensional relationships could be advantageously used. Finally, a single ply of absorbent material is applied to the last half inch of the adhesive tail. This portion of the adhesive tail is thus non-bonding and forms a pull tab that can be used to open the completed sweat band pocket pack.

The sweat band has been designed to be worn by wrapping around the forehead between the hairline and the eyebrows, and above the ears. The band length will allow for a double thickness (twenty-four plies) of absorbent material over the area of heaviest perspiration. The band length is such that one size fits all. The band design allows for infinite tension adjustment. The band is put into place as previously described and adjusted to the desired tension. The adhesive tail is pressed and bonded to the outside of the binder.

Sweat cuffs are of identical design and construction, except the preferred construction contemplates a band four inches wide and eighteen inches long. Also, two binder laminations are contemplated for the sweat cuffs.

DESCRIPTION OF THE DRAWINGS

The invention may take form in certain parts and arrangements of parts, preferred embodiments of which will be described in detail in this specification and illustrated in the accompanying drawings which form a part hereof and wherein.

DESCRIPTION OF PREFERRED EMBODIMENT

Figure 1:
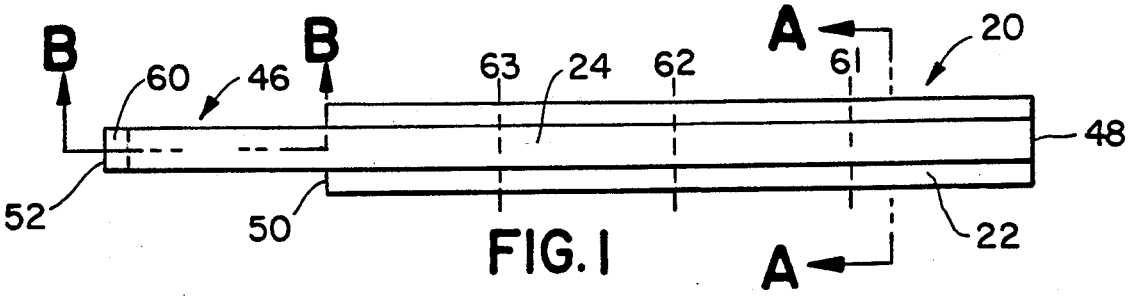
FIG. 1 is an overall plan view of the subject new sweat band.

Referring to the accompanying drawings which show several of the preferred embodiments of the invention, FIG. 1 shows a plan view of the assembled sweat band ready to be worn by the user. The sweat band 20 may exist in any length and width within practical limits. A practical size for a fabricated absorbent pad 22 as used in a head band is one and one half inches wide with a length of twenty-seven inches. The overall length of a binder 24 is thirty-two inches long and three quarters of one inch wide.

Figure 2A:
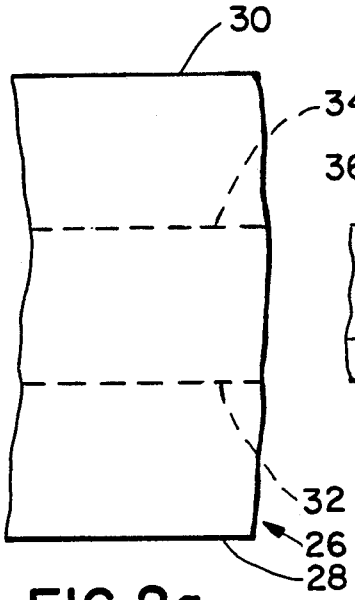
FIG. 2*a* shows a two-ply paper towel prior to the folding step used in the process of making a sweat band in accordance with the invention.
Figure 2B:
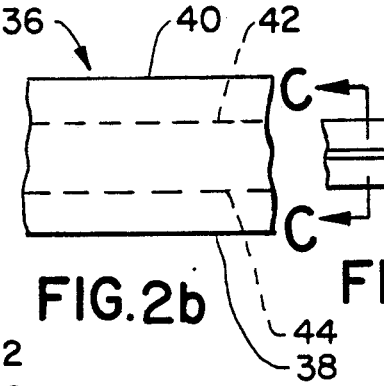
FIG. 2*b* shows a six-ply paper towel in a later stage in the process of making the sweat band.
Figure 2C:
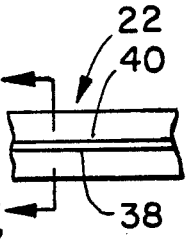
FIG. 2*c* shows a twelve-ply paper towel in a still later stage in the process of making the sweat band.
Figure 2D:
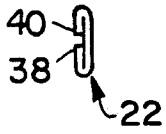
FIG. 2*d* is a cross-sectional end view of the pad taken along lines C—C of FIG. 2*c;*

Referring to FIG. 2*a*, the absorbent pad 22 is preferably formed from a single web 26 of two plies of embossed paper toweling having edges 28 and 30. The web 26 will be folded longitudinally along fold lines 32 and 34. Edge 28 is folded to align with fold line 34 and edge 30 is folded to align with fold line 32. This forms a six ply web 36 as shown in FIG. 2*b*. Web 36 having edges 38 and 40 is again folded longitudinally along fold lines 42 and 44 with edges 38 and 40 aligning and meeting each other. This forms a twelve ply web, which is the perspiration absorbent pad 22 of the sweat band 20 as shown in FIGS. 2*c* and 2*d*. If desired, the pad 22 may be impregnated with insect repellent or an attractive scent. One side of the pad 22 may be coated to accept printing or advertisements. Short-term bio-degradable cotton cloth can also be used.

Figure 4:
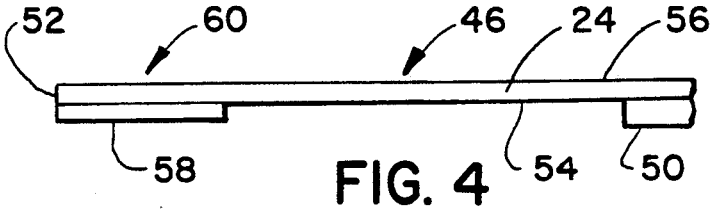
FIG. 4 is a cross section of the binder lamination taken along lines B—B of FIG. 1.
Figure 3:
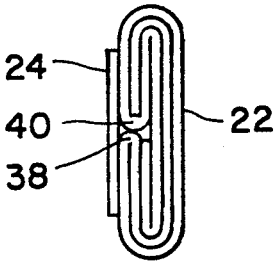
FIG. 3 is a cross sectional end view of the assembled sweat band taken along lines A—A of FIG. 1.

The binder lamination 24 shown in FIG. 3, is bonded to the absorbent pad 22 with long open time pressure-sensitive adhesive. Such adhesive is already known in the art and does not itself form a part of the present invention. The binder lamination 24 is positioned on the pad 20 so that the centerline of the binder 24 is parallel to and substantially between the edges 38, 40 of the pad 22. Referring again to FIG. 1, pad 22 and binder 24 are assembled so that the binder 24 extends beyond pad 22 to form a tail 46. As best shown in FIG. 4, the outer terminal end 52 of the tail 46 has applied to it a single ply of paper toweling material 58. This forms a non-bonding tab 60 on the outer or first end 52 of the tail 46. The underside portion 54 of the tail 46 is coated with long open time pressure-sensitive adhesive.

Figure 5:
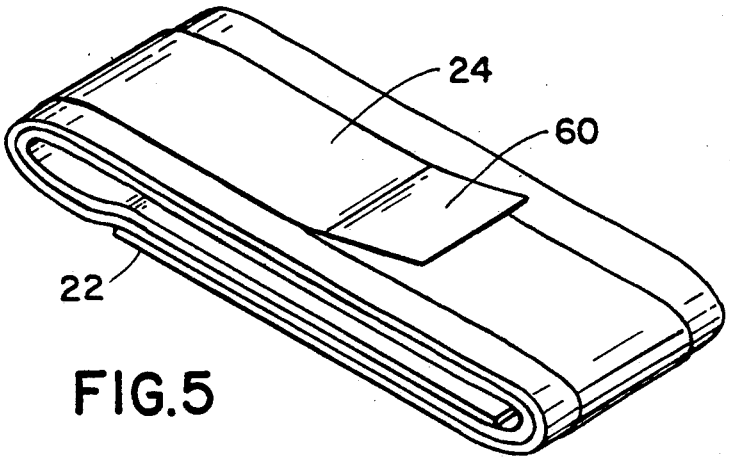
FIG. 5 shows the sweat band pocket pack.

Referring to FIG. 1, the sweat band 20 may be arranged in a convenient form by folding the first end 48 of the pad 22 toward the center of the sweat band 20. By folding the pad 22 at fold lines 61, 62, 63, the adhesive on the underside 54 of the tail 46 will wrap around and bond to the top side 56 of the binder 24, thus forming the sweat band pocket pack illustrated in FIG. 5. In the preferred embodiment, fold lines 61, 62, 63 are spaced approximately six inches apart.

Figure 6:
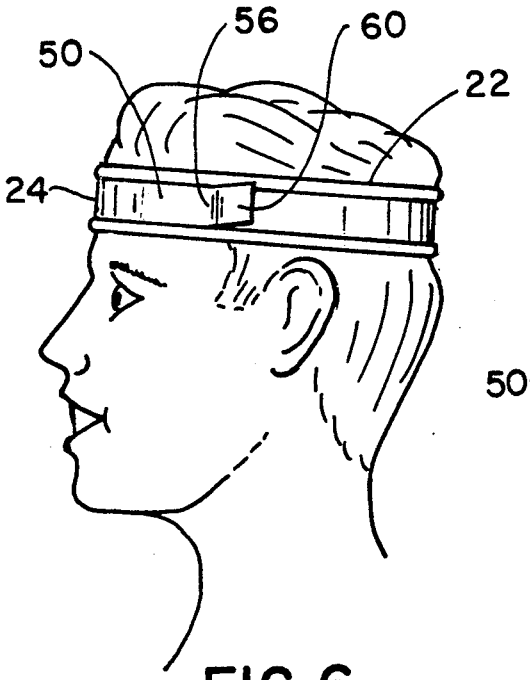
FIG. 6 shows the sweat band in place around the user's forehead.

The sweat band 20 is shown as worn on the user's forehead in FIG. 6. With reference to FIGS. 1 and 4–7, the pull tab 60 is used to adjust the circumference of the sweat band 20 to adapt for different size heads and to adjust tension in the band. When the desired tension is determined, the adhesive tail 46 is pressed and bonded to the binder 24, locking the sweat band 20 in place. This demonstrates the infinite adjustability of the sweat band. Pull tab 60 does not bond to the binder 24, so it can be used to remove the band when saturated or ready for disposal.

Figure 7:
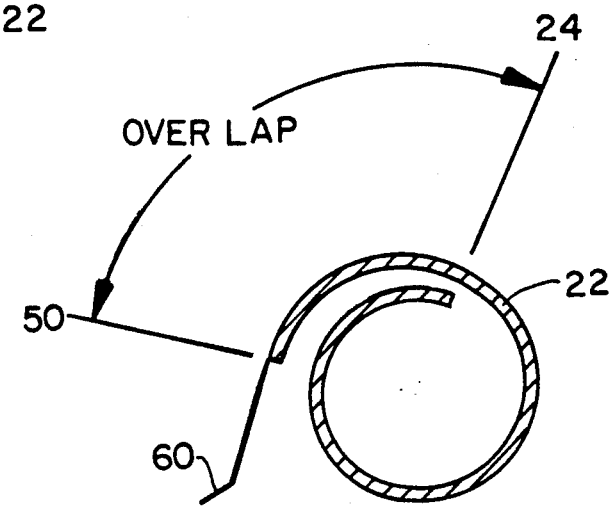
FIG. 7 shows the sweat band overlap.

FIG. 7 shows how a double absorbent pad 22 of twenty-four plies, i.e., overlapped section of twelve plies each, is advantageously formed over the brow or area of heaviest perspiration of the user. With the absorbent pad 22 completely around the user's forehead, there is no possibility for perspiration to escape and flow into the eyes, eye glasses or contact lenses. As will be apparent from FIGS. 6 and 7, as one area of the band becomes saturated, it can be easily rotated on the user's head so that a drier area of the band is positioned over the area of heavy perspiration.

Figure 8:
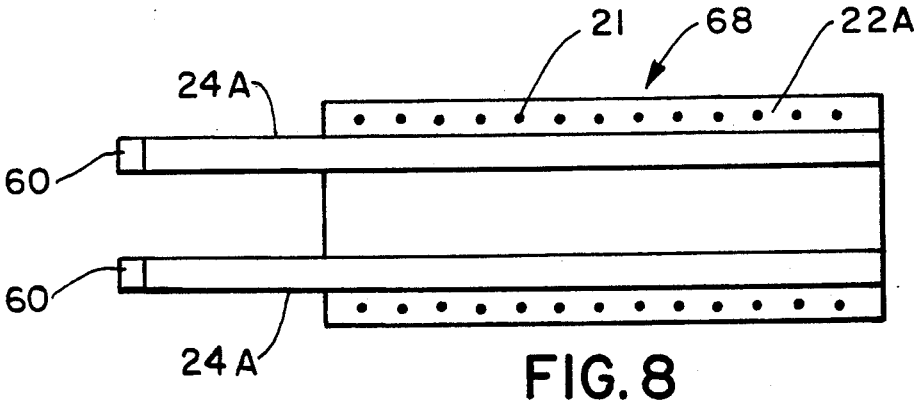
FIG. 8 shows application of the subject inventive concept to sweat cuffs; and, FIG. 9 shows the sweat cuffs of FIG. 8 as worn on the user's forearm.
Figure 9:
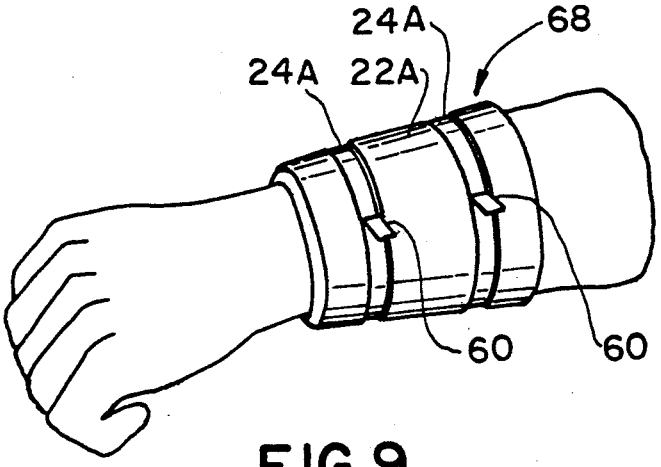

Referring to FIG. 8, shows an alternate sweat band adapted for use as sweat cuffs 68. The plies are formed as previously described, except a row of embosses 21 have been added near the side edges of the pad. The embosses 21 help lock the plies of the pad 22A together. This is more necessary in the sweat cuffs 68 due to their increased width over the sweat band 20. As many rows of embosses 21 can be used as required, and they may be continuous or of intermittent configuration. The absorbent pad 22A is of identical construction as pad 22 except for modified length and width dimensions. The binder lamination 24A is identical to lamination 24 except for a modified length. Sweat cuffs 68 preferably use two binder laminations 24A as shown. The cuffs 68 are worn on the forearm in the same manner as the sweat band 20.

One skilled in the art will in the future envision modifications and changes, and it is not desired to limit the invention to the specific use and construction shown. Also suitable changes and modifications may be considered within the scope of this invention.

Having thus described my invention, I now claim:

1. A sweat band to be worn on the body to collect and control perspiration comprising:

a long flat pad of absorbent material having a first and second end and comprising a plurality of folded plies, a first side of said pad having no folded edges, a second side of said pad having two folded edges; and, a binder lamination having a top side and an underside, the underside being coated with a non-drying pressure-sensitive adhesive, a first end of said binder lamination being aligned with said first end of said absorbent pad, the longitudinal centerline of the said binder being substantially aligned with the two folded edges of the said absorbent pad, said binder lamination being pressed and bonded to said absorbent pad, said binder lamination having a tail portion which extends beyond said absorbent pad and which has its underside coated with the non-drying pressure-sensitive adhesive, the tail having a non-stick pull tab at a first end of the tail, said pad, binder, tail, and tab being operative to form a pocket pack with a pull tab, whereby the sweat band is conveniently stored or carried.

2. The sweat band as defined in claim 1 wherein the long absorbent pad material comprises short-term bio-degradable paper toweling.

3. The sweat band as defined in claim 1 wherein the binder lamination comprises bio-degradable long fibered paper.

4. The sweat band as defined in claim 1 wherein the first end of the tail portion only of the binder lamination is bonded to a single ply of paper to form the non-stick pull tab.

5. The sweat band as defined in claim 1 wherein the binder lamination comprises short-term bio-degradable cotton cloth.

6. The sweat band as defined in claim 5 wherein the binder lamination comprises short-term bio-degradable cotton cloth with one side coated to accept printing.

7. The sweat band as defined in claim 5 wherein the binder of bio-degradable cotton cloth is coated with long open time adhesive.

8. The sweat band as defined in claim 1 wherein said absorbent pad is dimensioned as required for sweat cuffs and further including a second binder lamination spaced from and generally parallel to the first binder lamination.

9. The sweat band as defined claim 1 wherein the absorbent pad material is scented.

10. The sweat band as defined in claim 1 wherein the absorbent pad contains an insect repellent.

11. The sweat band as defined claim 1 wherein the absorbent pad is assembled with embossing.

12. The sweat band as defined in claim 11 wherein the embossing is located along the edges of the absorbent pad.

13. The sweat band as defined in claim 1 wherein the pocket pack is formed by folding the first end of said pad inwardly toward the second end of said pad, a resulting first fold line being about six inches from the first end of the pad;

folding the pad again so the first fold line is pivoted inwardly about a second fold line, the second fold line being about six inches from the first fold line;

repeatedly folding the pad in the same manner until the pad is in the form of several layers of approximately six inches in length; and, wrapping the binder around the folded pad so that a portion of the underside of the binder aligns with the top side of another portion of the binder.

14. The sweat band as defined in claim 1 wherein the absorbent pad has a length such that the opposed ends are disposed in overlapping relation to each other when the sweat band is installed around the dead of a user.

15. A method of forming a sweat band from a sheet of absorbent material having a centerline and four edges and a binder having an underside coated with a pressure-sensitive adhesive, the method comprising the steps of:

folding the sheet a first time so that the pair of edges which are parallel to the centerline are aligned with and adjacent to the centerline, thereby forming a first pair of fold edges;

folding the sheet a second time so that the first pair of fold edges are aligned with and adjacent to the centerline, thereby forming a second pair of fold edges;

positioning the binder over the pad so that the underside of the binder is facing the second pair of folded edges and the longitudinal centerline of the binder is parallel to and between the second pair of fold edges; and, pressing the binder against the pad so that the pressure-sensitive adhesive binds the binder to the pad and retains the second pair of fold edges in contiguous relation to each other.

* * * * *